US006615424B1

(12) United States Patent
Cheng

(10) Patent No.: US 6,615,424 B1
(45) Date of Patent: Sep. 9, 2003

(54) BASE OF A FOLDABLE BABY BED

(75) Inventor: Ying-Hsiung Cheng, Tainan Hsien (TW)

(73) Assignee: Pao-Hsien Cheng, Tainan Hsien (TW)

( * ) Notice: Subject to any disclaimer, the term of this patent is extended or adjusted under 35 U.S.C. 154(b) by 0 days.

(21) Appl. No.: 10/300,631

(22) Filed: Nov. 21, 2002

(51) Int. Cl.[7] ..... A47C 7/00

(52) U.S. Cl. ..... 5/99.1; 5/93.1; 5/98.2; 5/98.1

(58) Field of Search ..... 5/99.1, 98.1, 98.2, 5/93.1

(56) References Cited

U.S. PATENT DOCUMENTS 5,446,931 A * 9/1995 Wei ..... 5/98.1
6,170,099 B1 * 1/2001 Cheng ..... 5/99.1
6,256,814 B1 * 7/2001 Drobinski ..... 5/99.1
6,305,037 B1 * 10/2001 Cheng ..... 5/99.1
6,336,234 B1 * 1/2002 Kuo ..... 5/99.1
6,349,434 B1 * 2/2002 Zhuang ..... 5/99.1
6,473,919 B1 * 11/2002 Wang ..... 5/99.1
6,510,569 B1 * 1/2003 Hu ..... 5/99.1
2002/0170111 A1 * 11/2002 Cheng ..... 5/99.1

* cited by examiner

*Primary Examiner*—Teri Pham Luu
(74) *Attorney, Agent, or Firm*—Rosenberg, Klein & Lee

(57) ABSTRACT

An improvement on a base of a baby bed has a locking plate having a central elongated hole, and two locking holes at two ends. The locking plate can be moved up and down for unlocking and locking the base. The locking holes retain respective engaging pins, with which lower support rods of the base are associated, when the locking plate is in the locking position. Owing to increased length of the elongated hole, the locking plate can slide lengthwise besides moving up and down. Therefore, in case one of the locking holes fails to disengage its corresponding engaging pin completely when the locking plate is moved to allow folding operation of the baby bed, the engaging pin still can be disengaged from the locking hole automatically on the course of exerting force on the lower support rods to fold the bed.

11 Claims, 9 Drawing Sheets

BASE OF A FOLDABLE BABY BED

BACKGROUND OF THE INVENTION

1. Field of the Invention

The present invention relates to a base of a foldable baby bed, more particularly a base of a foldable baby bed, which can be folded smoothly, and which has relatively uncomplicated structure.

2. Brief Description of the Prior Art

The applicant of the present invention disclosed a base of a foldable baby bed as shown in FIGS. 8 and 9 in U.S. patent application, Ser. No. 09/859,382, now abandoned.

Referring to FIGS. 8, and 9, the base of a foldable baby bed frame 4 includes four supporting feet 41, a middle support 1, four connecting members 2, and four horizontal support rods 3. Vertical support rods of the frame 4 are connected to respective ones of the supporting feet 41. The horizontal support rods 3 are pivotally connected to respective ones of the feet 41 at outer ends thereof.

The middle support 1 consists of a main body, and a locking mechanism, which includes a control 14, a locking plate 193, and two pivotal shafts 17. The main body of the middle support 1 has a through hole 11 on a center of a top thereof, two juxtaposed parallel connecting holes 16, and gaps 161, which are formed on two lateral sides to communicate with respective connecting holes 16. The main body has curved recesses 151 formed at two ends of the top to face respective gaps 161. The main body 1 has an elongated hole 131 extending from a front side to a rear side, and recesses 13 around two ends of the elongated hole 131.

Each of the connecting members 2 has a hole 21, a extending post 23, a connecting room 22, which is defined by first and second stopping wall 221, 222.

Each of the pivotal shafts 17 is turnably passed through respective connecting holes 16 with two ends thereof sticking out from the main body, and has an engaging pin 171 sticking out from a middle thereof to be received in the gap 161.

The control 14 has a handle, and holed cams 142 at two ends of the handle. The locking plate 193 has locking holes 194 at two ends, and a round hole in the middle.

In combination, the horizontal support rods 3 are passed into the holding room 22 of respective connecting members 2 at inner ends thereof, and are pivotally connected thereto. The connecting holes 21 of the connecting members 2 are connected to respective ends of the pivotal shafts 17. The locking plate 193 is arranged in the main body of the middle support 1. The holed cams 142 of the control 14 are mounted onto respective recesses 13 of the main body, and a pin 143 is passed through the elongated hole 131 and the cams 142 so that the control 14 is pivoted to the main body. The pin 143 is also passed through a connector 12, which is up and down movably positioned in the hole 11. A bolt 19 is passed through the connector 12, a spring 191, the central round hole of the plate 193, a spring 192, and screwed into a nut in sequence at a lower portion.

Thus, the control 14 can be pivoted on the main body to control position of the locking plate 193; when the cams 142 are positioned upright, the locking plate 193 will be positioned at an upper position capable of engaging the engaging pin 171 so that the baby bed is fixed in stretched position; when the cams 142 are positioned in laid down position, the locking plate 193 will be positioned at a lower position not capable of engaging the engaging pin 171, allowing the bed to be folded.

The base of the baby bed can be unlocked to be foldable by means of moving the control 14. However, the base is found to have disadvantages as followings:

1. The locking mechanism of the base consists of many parts, and the structure is complicated. Therefore, assembling costs much labor and time, and manufacturing cost of the base is increased.
2. Should one of the locking holes 194 fail to disengage its corresponding engaging pin 171 completely when the locking plate 193 is moved to the lower position to allow folding operation of the baby bed, the corresponding pivotal shaft 17 can't be turned. Consequently, damage is likely to be caused to the pivotal shaft 17, the engaging pin 171, the locking plate 193 and other associated parts if corresponding support rods 3 are still forced to cause this pivotal shaft 17 to turn.

SUMMARY OF THE INVENTION

Therefore, it is a main object of the present invention to provide a base of a foldable baby bed, which is not subject to damage in folding operation of the baby bed in case the locking mechanism fails to unlock completely.

It is another object of the present invention to provide a base of a foldable baby bed, which has relatively uncomplicated structure, and can be assembled easily and with less labor.

The improvement on the baby bed base mainly has an elongated hole, which is provided on the center of the locking plate instead of the conventional round hole. Therefore, the locking plate can slide lengthwise over the top of the middle support of the base besides moving up and down for locking and unlocking of the pivotal shafts, to which the horizontal support rods of the baby bed base are connected.

In case one of the locking holes of the locking plate fails to disengage its corresponding pivotal shaft completely when the locking plate is moved to allow folding operation of the baby bed, the corresponding pivotal shaft still can be disengaged from corresponding locking hole to be turned because the elongated hole is so long as to allow the locking plate to move in a direction same as the longer side of the locking plate for certain distance.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
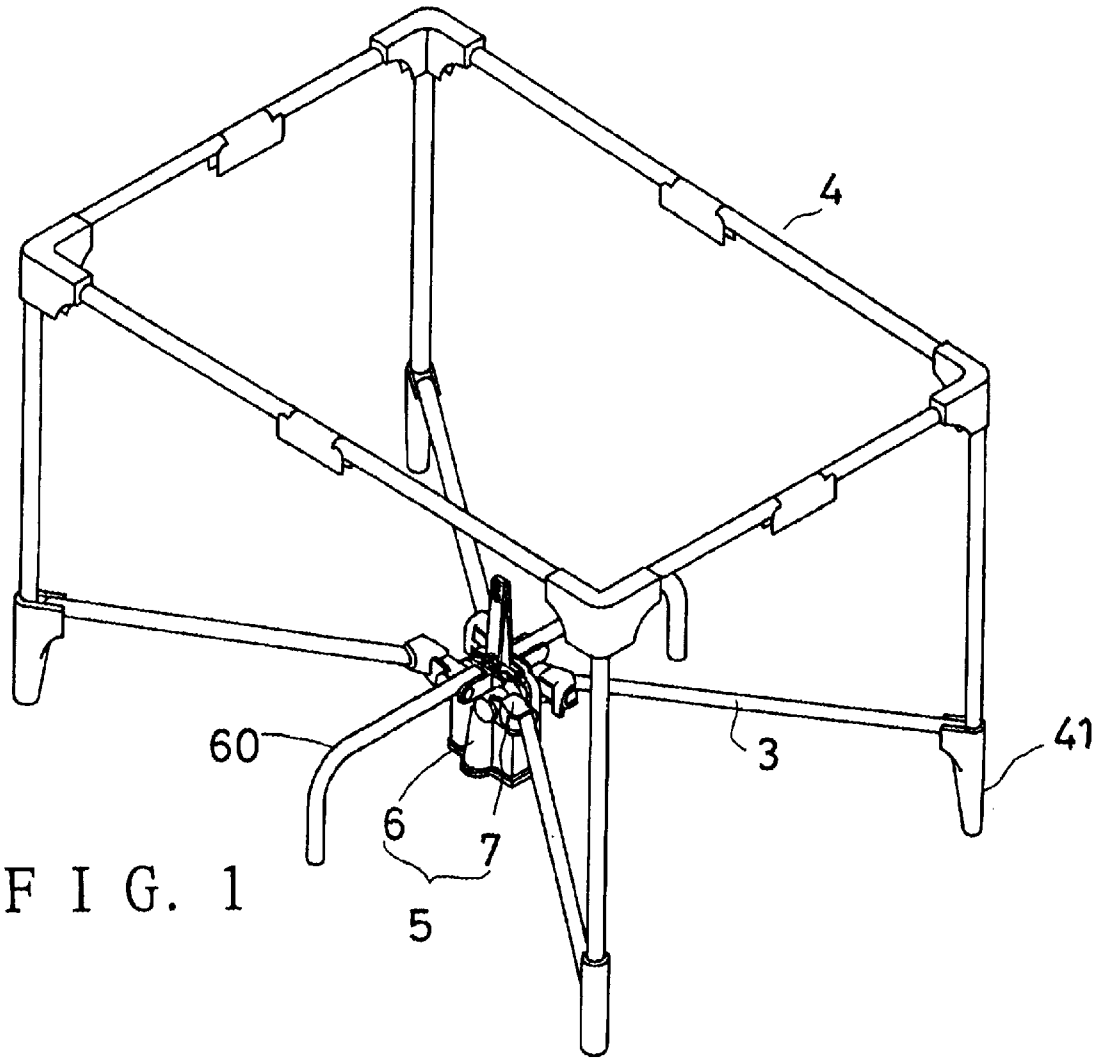
FIG. 1 is a perspective view of the frame of the foldable baby bed according to the present invention.
Figure 2:
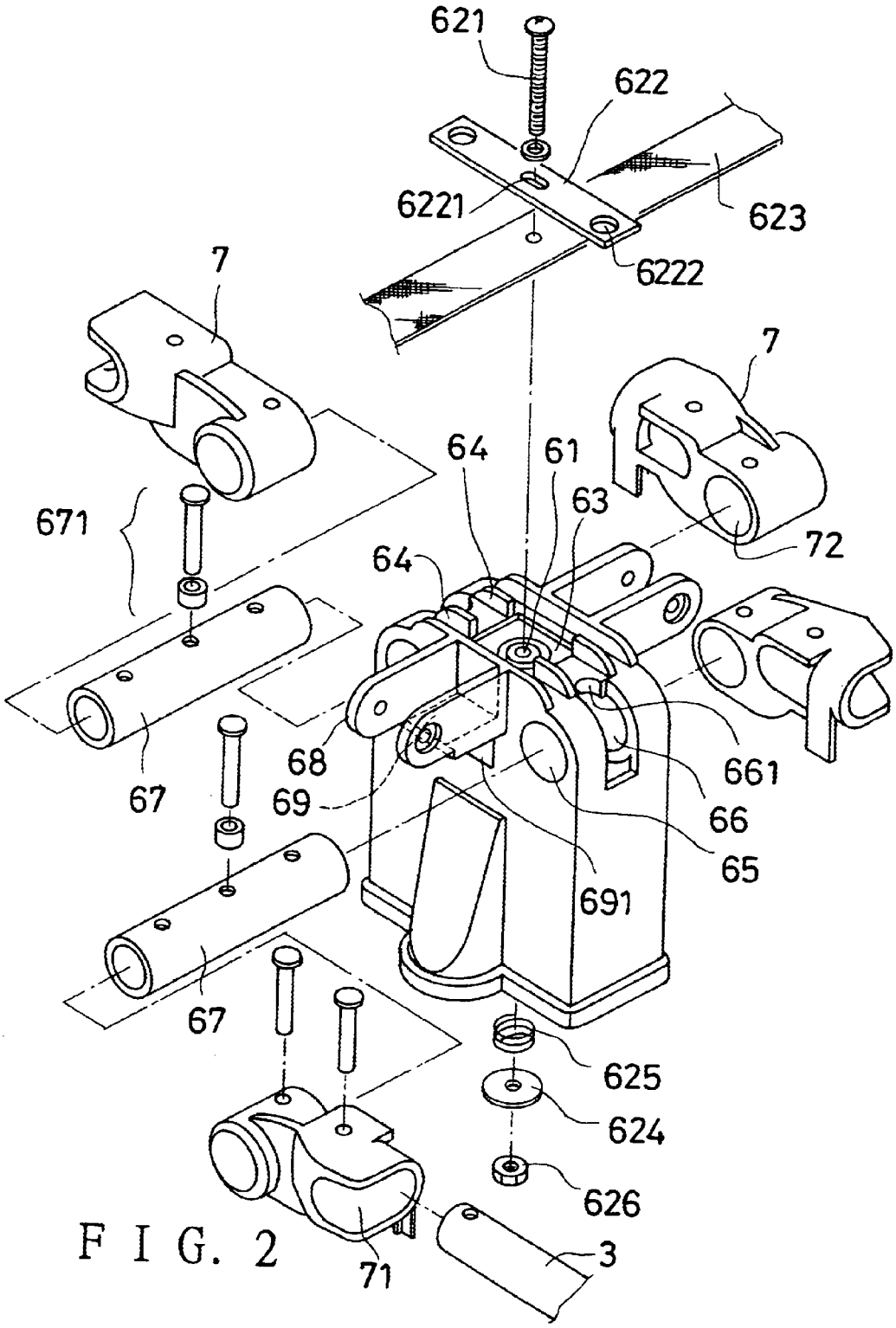
FIG. 2 is a fragmentary exploded perspective view of the base of a foldable baby bed according to the present invention.

Referring to FIGS. 1, and 2, a base of a frame 4 of a foldable baby bed of the present invention includes four supporting feet 41, two auxiliary supporting feet 60, a middle support 5, and four horizontal support rods 3.

Vertical support rods of the frame 4 are connected to respective ones of the supporting feet 41. And, the horizontal support rods 3 are pivotally connected to respective ones of the feet 41 at outer ends thereof.

The middle support 5 consists of a main body 6, four connecting members 7, and a locking mechanism, which includes two pivotal shafts 67, and a locking plate 622.

Figure 3:
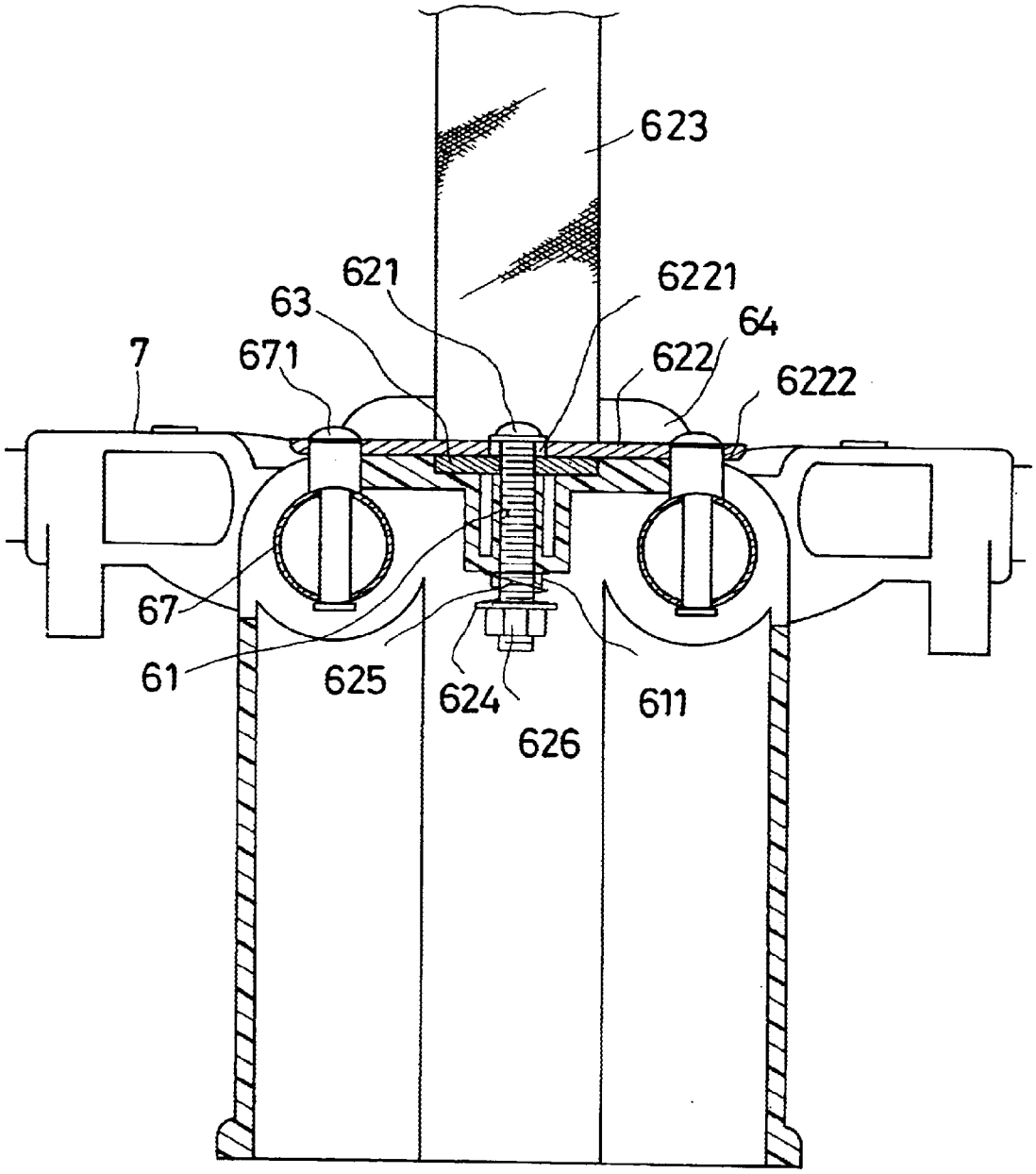
FIG. 3 is a front view of a middle support of the base of a foldable baby bed according to the present invention.
Figure 4:
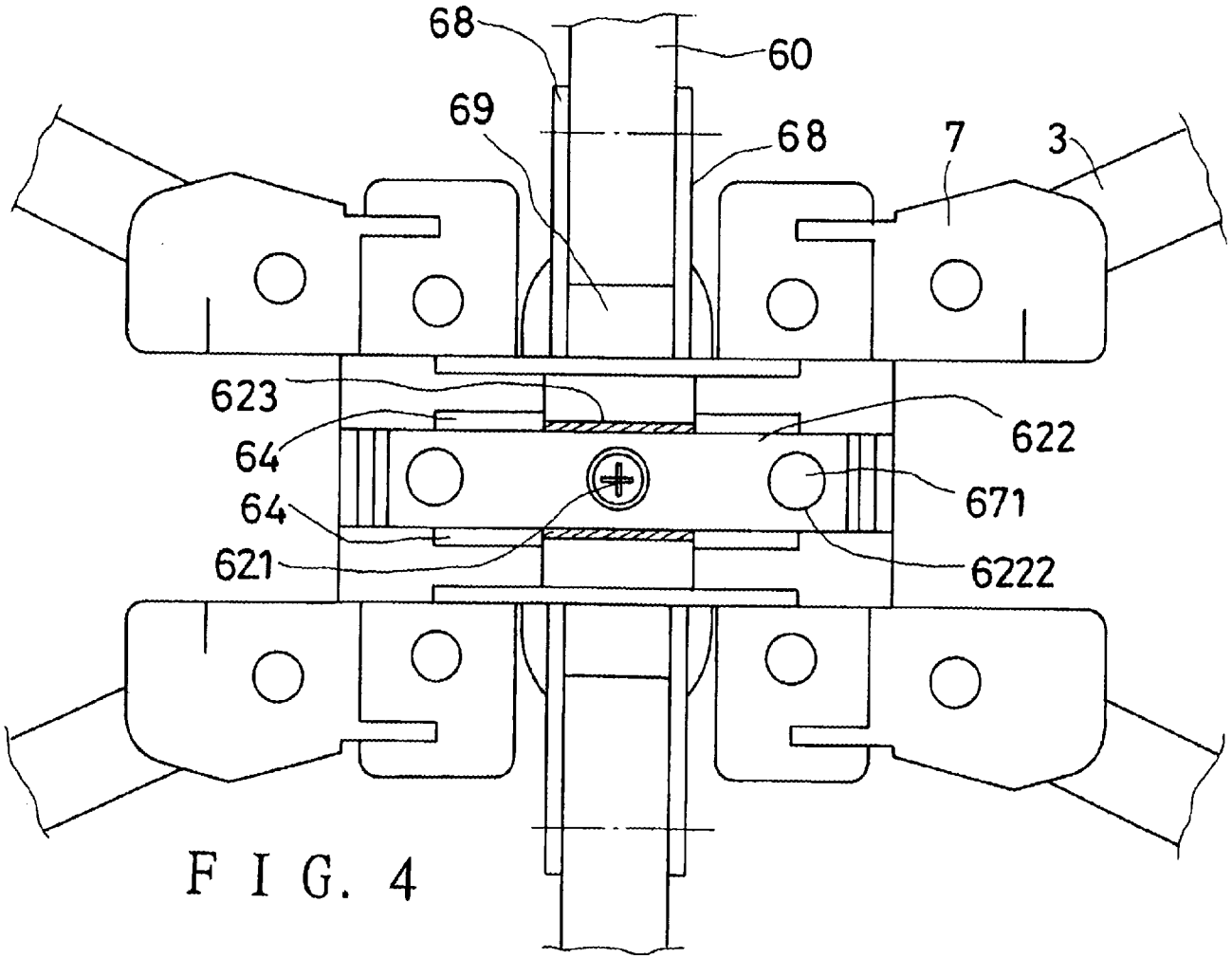
FIG. 4 is a top view of the middle support of the base, of a foldable baby bed according to the present invention.
Figure 5:
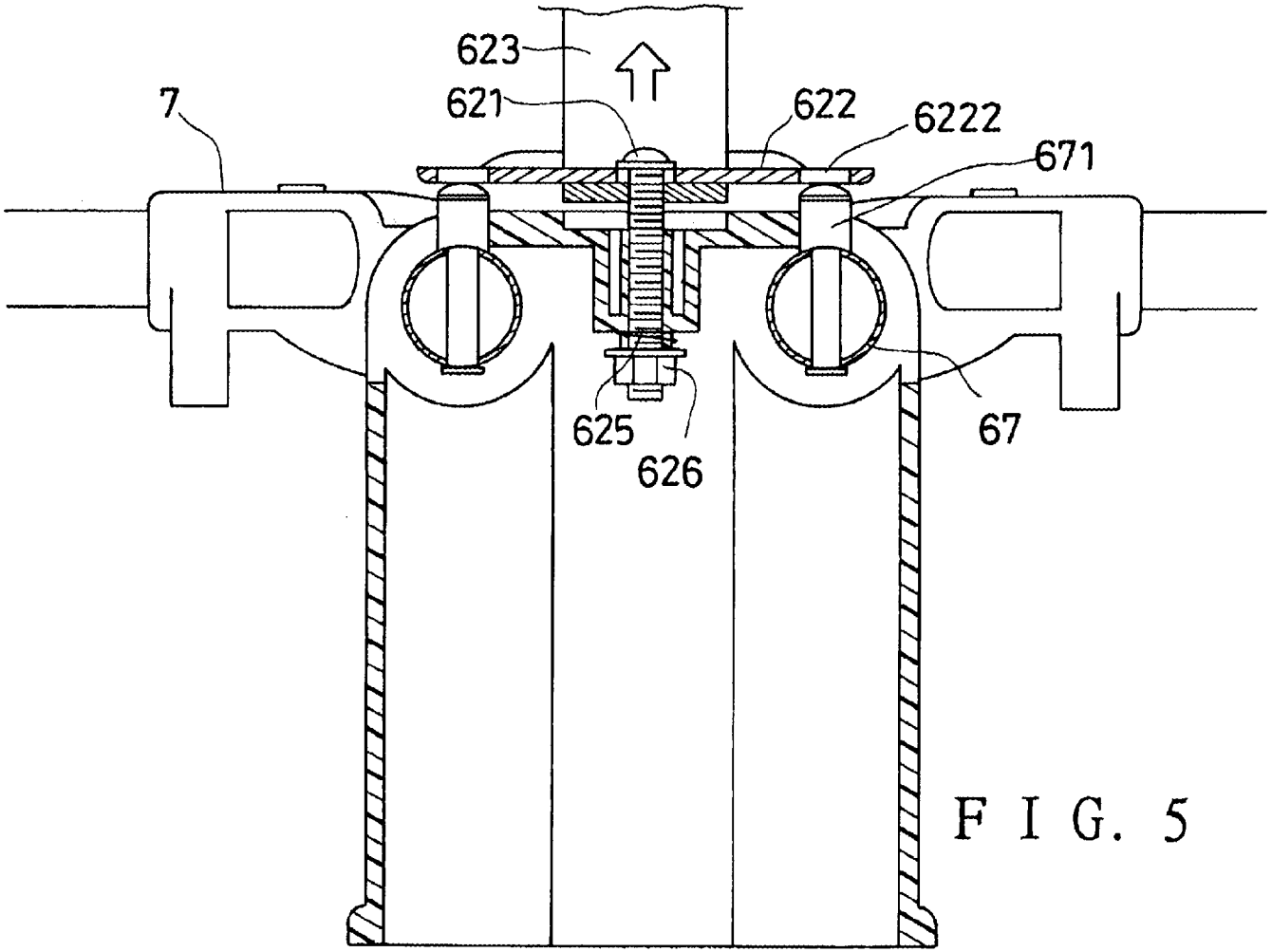
FIG. 5 is a view of the middle support of the base of a foldable baby bed under a first step of folding operation according to the present invention.
Figure 6:
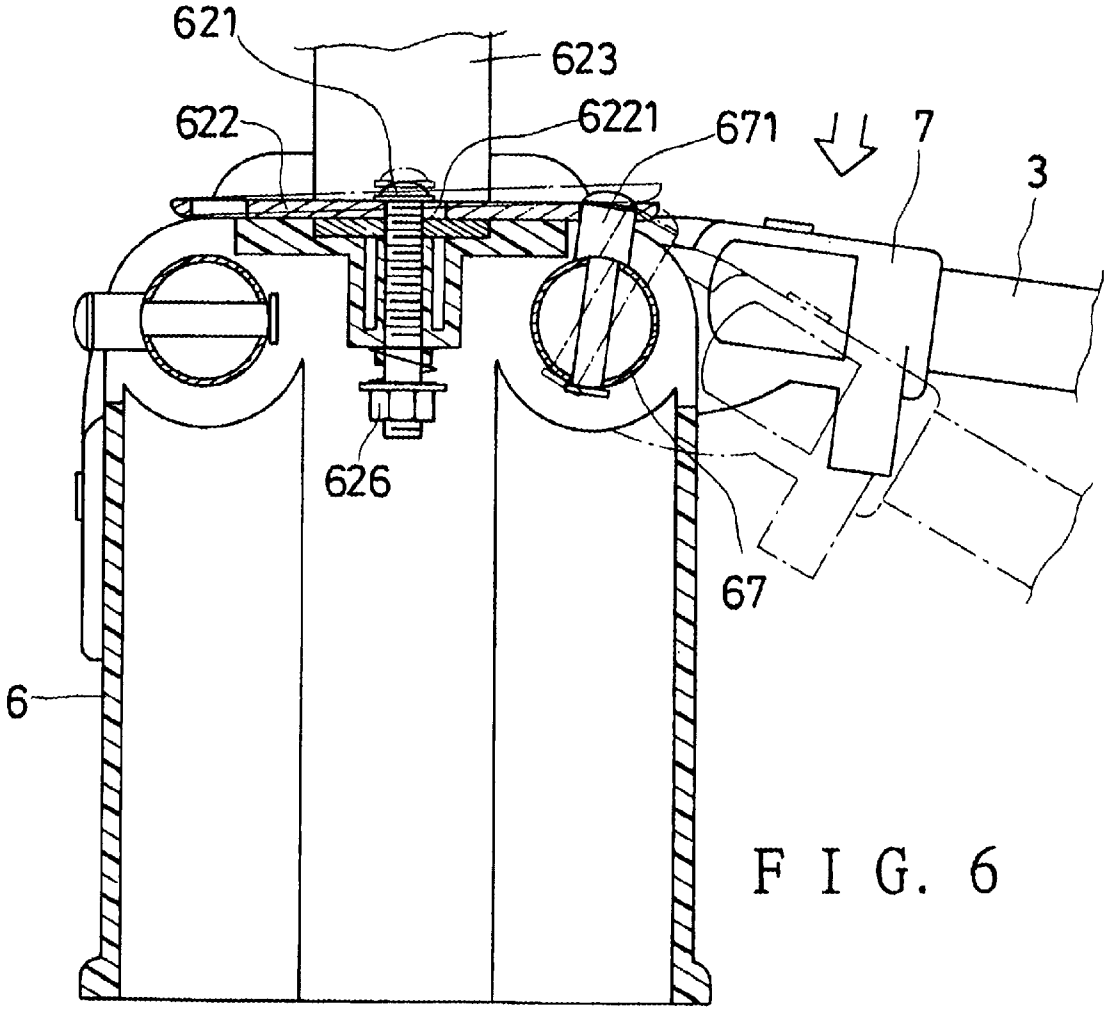
FIG. 6 is a view of the middle support of the base of a foldable baby bed under a second step of folding operation according to the present invention.
Figure 7:
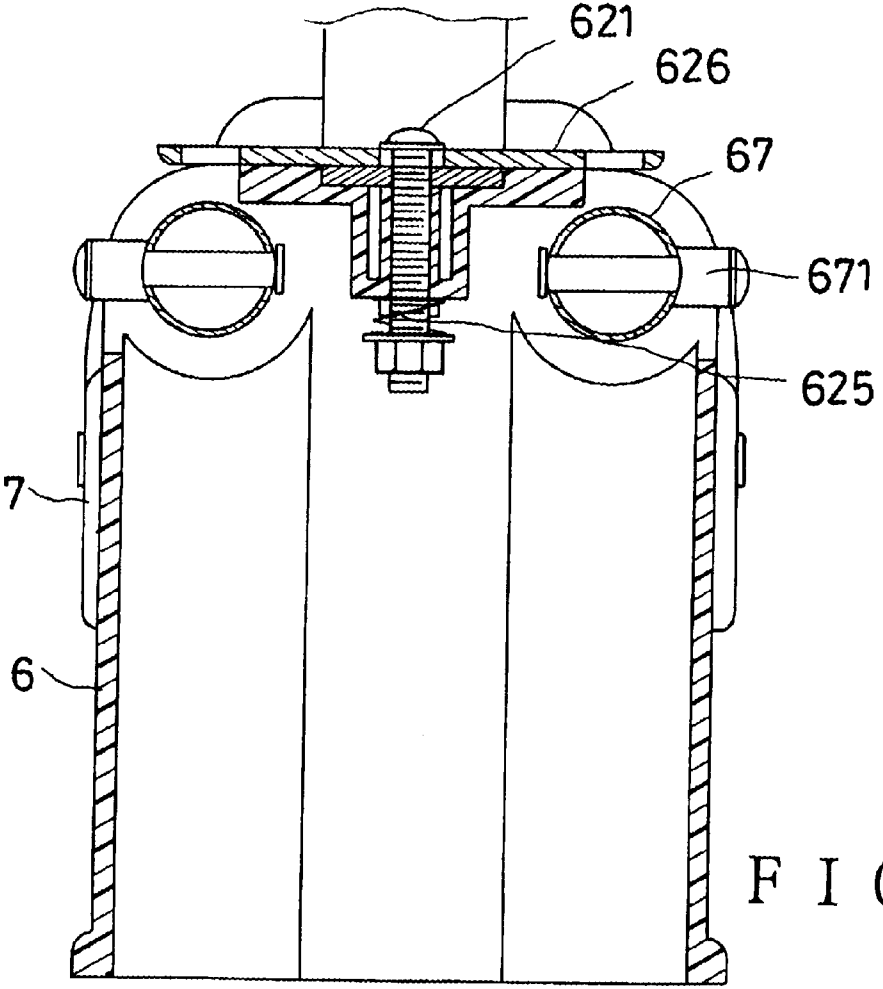
FIG. 7 is a view of the middle support of the base of a foldable baby bed in folded position according to the present invention.
Figure 8:
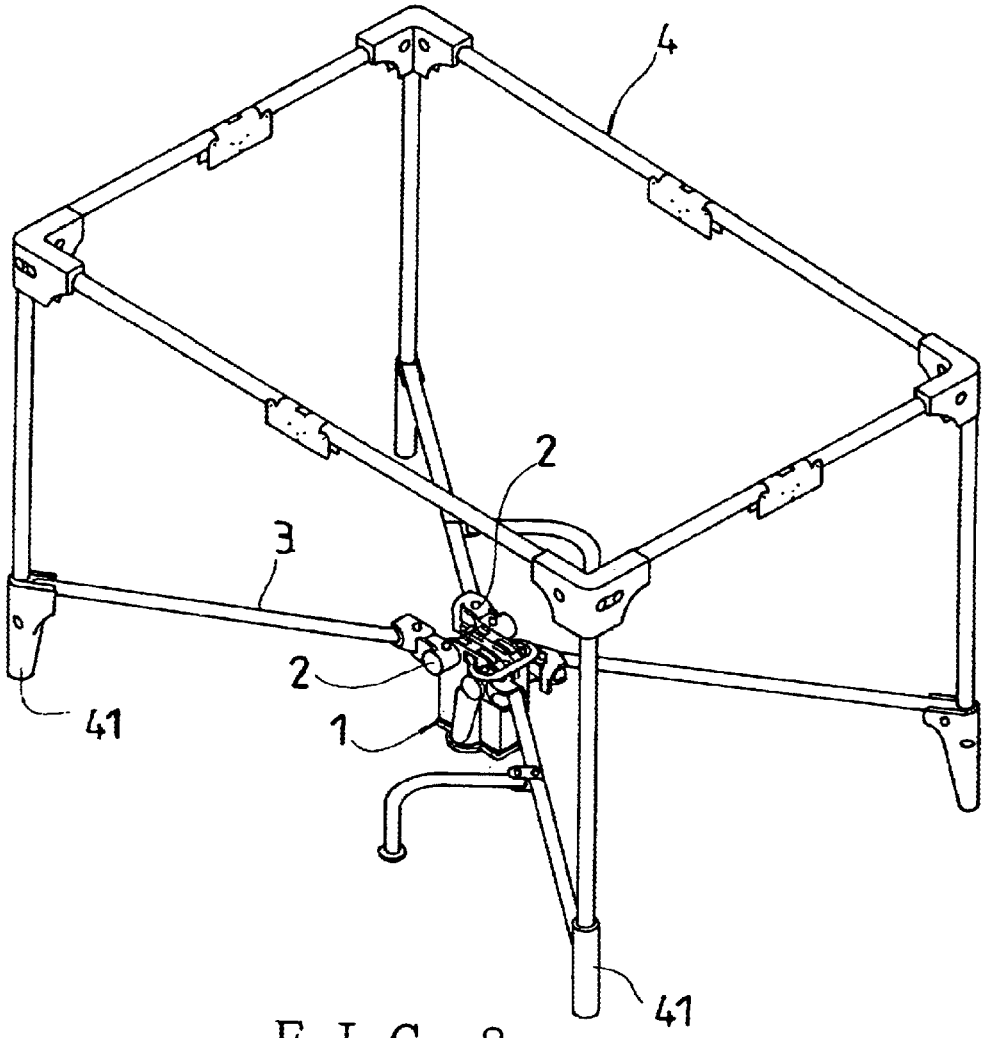
FIG. 8 (PRIOR ART)
FIG. 8 is a perspective view of the frame of the conventional foldable baby bed as described in the Background; and, FIG. 9 is a fragmentary exploded perspective view of the conventional foldable baby bed base.
Figure 9:
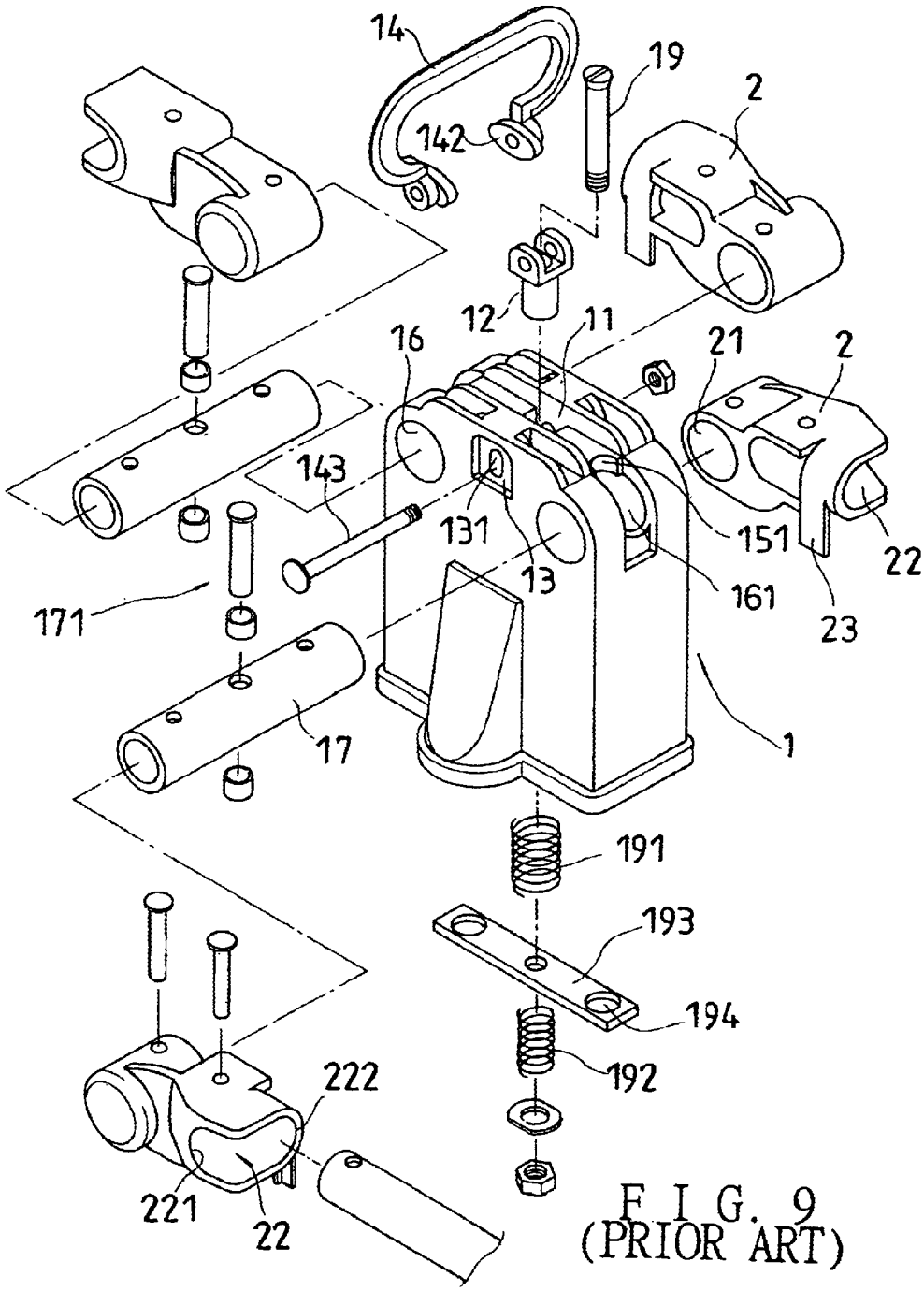
FIG. 9 (PRIOR ART)

The main body 6 has a through hole 61 on a center of a top thereof, two juxtaposed parallel connecting holes 65, and gaps 66, which are on two lateral sides to communicate with respective ones of the parallel connecting holes 65. The main body 6 has curved recesses 661 formed at two ends of the top to face respective gaps 66. The main body 6 has a recess 63 around the through hole 61 on the top side, and two pairs of opposite confining plates 64 on the top next to the recess 63. Furthermore, each of two opposite longer sides of the main body 6 has two parallel connecting ears 68, each of which has a pivotal hole. Supporting plates 69 are formed between lower edges of the parallel connecting ears 68, and strengthening plates 691 are formed under the supporting plates 69 to strengthen the same. In addition, an annular protrusion 611 is formed around a lower end of the through hole 61 of the main body 6 as shown in FIG. 3.

Each of the pivotal shafts 67 of the locking mechanism is turnably passed through respective parallel connecting holes 65 with two ends thereof sticking out from the main body 6, and has an engaging pin 671 sticking out from a middle thereof to be received in the gap 66 of the main body 6.

Each of the connecting holes 7 has a holding room 71, and a connecting hole 72.

The locking plate 622 has two locking holes 6222 on two ends, and an elongated hole 6221, which is formed on a middle and parallel to a longer side thereof.

In combination, the horizontal support rods 3 are passed into the holding room 71 of respective ones of the connecting members 7 at inner ends thereof, and are pivotally connected thereto. The connecting members 7 are mounted around respective ends of the pivotal shafts 67 at the connecting holes 72 thereof, and rivets (not numbered) are used to fix the connecting members 7 to the pivotal shafts 67.

The locking plate 622 is positioned over the recess 63, and confined between the confining plates 64 of the main body 6 with the elongated hole 6221 thereof facing the through hole 61. A strap 623 is passed across a bottom of the locking plate 622, and has a hole (not numbered) aligned with the elongated hole 6221; that section of the strap 623 passed across the bottom of the locking plate 622 being held in the recess 63. A bolt 621 is first passed through the elongated hole 6221, and the hole of the strap 623, and the through hole 61, and is passed through a spring 625, a washer 624, and screwed into a nut 626, which are all arranged in sequence under the through hole 61. The spring 625 is mounted around the annular protrusion 611 (FIG. 3) at an upper end portion thereof.

The engaging pins 671 of the pivotal shafts 67 are positioned so that they stick right up, and are stopped by the curved recesses 661 when the baby bed is in the stretched position. The spring 625 can bias the locking plate 622 down to a lower position where the locking holes 6222 are mounted around, and engaged with, the engaging pins 671 to stop the pivotal shafts from turning when the baby bed is in the stretched position, i.e. when the engaging pins 671 stick right up. Thus, the locking plate 622 can be lifted by means of pulling the strap 623 upwards, and upward movement of the locking plate 622 is restricted by the annular protrusion 611 under the through hole 61, which will stop the nut 626 from moving further up in pulling the strap 623.

The auxiliary supporting feet 60 are passed into between, and pivotally connected to, respective pairs of connecting ears 68 at inner ends thereof to help support the baby bed. The inner ends of the auxiliary supporting feet 60 can be supported on the supporting plates 69 when the baby bed is in the stretched position.

To move the baby bed from the stretched position to folded position, first the strap 623 is pulled to lift the locking plate 622 for the locking holes 6222 to separate from the engaging pins 671. Then, the horizontal support rods 3 are pivoted on the connecting members 7, and the pivotal shafts 67 are forced to turn in the holes 65 of the main body by means of exerting force on the horizontal support rods 3; thus, the baby bed is folded.

To move the baby bed from folded position to stretched position, the horizontal support rods 3 are pivoted on the connecting members 7 to spread, and the pivotal shafts 67 are forced to turn in the holes 65 of the main body by means of exerting force on the horizontal support rods 3; because the elongated hole 6221 makes the locking plate 622 movable in a direction same as the longer side thereof for certain distance, upper ends of the engaging pins 671 can snap into the locking holes 6222 for the pivotal shafts 67 to be locked with the locking plate 622.

Should one of the locking holes 6222 fail to disengage its corresponding engaging pin 671 completely when the locking plate 622 is lifted for folding operation of the baby bed, the corresponding engaging pin 671 still can be moved out of the locking hole 6222, and the corresponding pivotal shaft 67 still can be turned because the elongated hole 6221 makes the locking plate 622 movable in a direction same as the longer side of the locking plate 622 for certain distance. Therefore, the baby bed still can be folded smoothly.

From the above description, it can be understood that the base of a foldable baby bed of the present invention has advantages as following:

1. The baby bed base consists of fewer parts than the conventional one as described in the Background, and the structure is less complicated. Therefore, manufacturing cost of the present base is relatively low, and assembling costs less labor and time.
2. Because the locking plate 622 can move lengthwise for certain distance, should one of the locking holes fail to disengage its corresponding engaging pin completely when the locking plate is lifted for folding operation of the baby bed, the corresponding pivotal shaft 67 still can be turned, and the baby bed still can be folded smoothly without risk of damage being caused to any part of the base. In other words, the baby bed is not subject to damage because of the structure of the locking mechanism.

What is claimed is:

1. A base of a foldable baby bed, comprising four feet, to which respective vertical support rods of a frame of a foldable baby bed are connected;

four horizontal support rods pivotally connected to respective ones of the feet at inner ends thereof; and, a middle support, the middle support including i. a main body provided for supporting the baby bed on ground together with the feet; the main body having two juxtaposed parallel connecting holes, a through hole on a center of a top, and gaps formed on two lateral sides to communicate with respective ones of the parallel connecting holes;

ii. a locking mechanism including a locking plate, and two pivotal shafts turnably passed through respective ones of the parallel connecting holes of the main body with two ends of the pivotal shafts, sticking out from the main body; the pivotal shafts having engaging pins sticking out from a middle thereof to be received within the gaps;

the horizontal support rods being pivotally connected to respective ones of four connecting members, each of which is connected to one of the ends of the pivotal shafts;

the locking plate having an elongated hole formed on a middle and parallel to a longer side thereof; the locking plate being up and down movably connected to the main body with a bolt passing through the elongated hole thereof and the through hole of the main body; the engaging pins being directed towards the locking plate so that locking holes of two ends thereof are separably engaged with the engaging pins to stop the pivotal shafts from turning when the baby bed is in a stretched position and when the locking plate is in a locking position;

the elongated hole being able to provide the locking plate with capability of moving lengthwise for such a distance that should one of the locking holes fail to disengage corresponding engaging pin thereof completely when the locking plate is lifted to allow folding operation of the baby bed, the corresponding engaging pin still can be moved out of the locking hole, and the corresponding pivotal shaft still can be turned for folding operation of the baby bed to be finished.

2. The base of a foldable baby bed as claimed in claim 1, wherein curved recesses are formed at two ends of the top of the main body to face corresponding gaps of the main body of the middle support, and the engaging pins are directed upwards, and stopped from moving further by the curved recesses when the baby bed is being stretched.

3. The base of a foldable baby bed as claimed in claim 1, wherein the locking plate is arranged above the pivotal shafts, and the engaging pins are directed upwards when the baby bed is in stretched position so that the locking holes can mount around the engaging pins when the locking plate is moved down to the locking position.

4. The base of a foldable baby bed as claimed in claim 3, wherein the locking mechanism further has a controlling member connected to the locking plate for moving the locking member up and away from the locking position with, and a spring is associated with the locking plate to bias the locking plate down to the locking position.

5. The base of a foldable baby bed as claimed in claim 4, wherein the spring is positioned under the top of the main body of the middle support, and the bolt is passed through the spring and screwed into a washer and a nut at a lower end so that the spring can bias the locking plate downwards; an annular protrusion being formed around a lower end of the through hole for the spring to mount around so that upward movement of the locking plate is restricted by the annular protrusion.

6. The base of a foldable baby bed as claimed in claim 1, wherein the main body of the middle support has confining projections on the top thereof and next to two long sides of the locking plate to guide up and down movement as well as lengthways moving action of the locking plate.

7. The base of a foldable baby bed as claimed in claim 1, wherein the controlling member is a strap, which is passed across a lower side of the locking plate, and a recess is formed around the through hole on the top of the main body for holding a portion of the strap therein that is passed under the locking plate.

8. The base of a foldable baby bed as claimed in claim 1, wherein two auxiliary supporting feet are pivotally connected to respective ones of two opposite sides of the main body of the middle support.

9. The base of a foldable baby bed as claimed in claim 8, wherein each of said opposite sides of the main body has two parallel connecting ears having pivotal holes for the auxiliary supporting feet to be pivoted thereto at inner ends.

10. The base of a foldable baby bed as claimed in claim 9, wherein supporting plates are formed between lower edges of the parallel connecting ears for the inner ends of the auxiliary supporting feet to be supported on.

11. The base of a foldable baby bed as claimed in claim 10, wherein the supporting plates are provided with strengthening plates under them.

* * * * *